US008987662B2

(12) United States Patent
Satulovsky

(10) Patent No.: US 8,987,662 B2
(45) Date of Patent: Mar. 24, 2015

(54) SYSTEM AND METHOD FOR PERFORMING TANDEM MASS SPECTROMETRY ANALYSIS

(75) Inventor: Javier E. Satulovsky, Santa Clara, CA (US)

(73) Assignee: Agilent Technologies, Inc., Santa Clara, CA (US)

( * ) Notice: Subject to any disclaimer, the term of this patent is extended or adjusted under 35 U.S.C. 154(b) by 1299 days.

(21) Appl. No.: 12/466,045

(22) Filed: May 14, 2009

(65) Prior Publication Data

US 2010/0288918 A1 Nov. 18, 2010

(51) Int. Cl.
*H01J 49/26* (2006.01)
*H01J 49/00* (2006.01)

(52) U.S. Cl.
CPC ..... *H01J 49/0036* (2013.01)
USPC ..... 250/287; 250/281; 250/282

(58) Field of Classification Search
USPC ..... 250/281, 282, 283, 286, 287; 702/19, 702/22, 23, 24, 25, 26, 27, 28
See application file for complete search history.

(56) References Cited

U.S. PATENT DOCUMENTS

| | | | | |
|---|---|---|---|---|
| 7,498,568 | B2 | 3/2009 | Overney et al. | |
| 2004/0251409 | A1* | 12/2004 | Le Blanc | 250/288 |
| 2007/0009898 | A1* | 1/2007 | Geromanos et al. | 435/6 |
| 2007/0282537 | A1* | 12/2007 | Freitas et al. | 702/19 |
| 2010/0167267 | A1* | 7/2010 | Schulzknappe et al. | 435/5 |

FOREIGN PATENT DOCUMENTS

EP 1 717 586 A1 11/2006

OTHER PUBLICATIONS

TJL Freeman et al., "Identification of biochemical pathway activity using mass spectrometry and probabilistic methods", 56th ASMS Conference on Mass Spectrometry. May 9, 2008, (Abstract only).
J. Meza, "Intelligent MS/MS acquisition results in higher sequence coverage and more confident protein IDs from complex samples" Eighth International Symposium on Mass Spectrometry in the Health and Life Sciences, San Francisco, CA, Aug. 19, 2007, p. 43. (Abstract only).
C. Shen et al., 2008, "A hierarchical statistical model to assess the confidence of peptides and proteins inferred from tandem mass spectrometry", Bioinformatics, 24: pp. 202-208.
S. Tanner et al., 2005, "InsPecT: Identification of posttranslationally modified peptides from tandem mass spectra" Anal. Chem. 77: pp. 4626-4639, Jul. 15, 2005.

(Continued)

*Primary Examiner* — Nicole Ippolito

(57) ABSTRACT

A system for performing tandem mass spectrometry (MS/MS) analysis of a sample includes a mass spectrometer and a processor. The mass spectrometer is configured to perform a mass spectrometry (MS) scan of an ionized sample to provide a mass of an observed peak corresponding to a precursor ion. The processor is configured to perform operations including determining whether the mass of the observed peak matches a mass of at least one of multiple expected peptides on a dynamic watch list, where the expected peptides correspond to a protein in the sample, and calculating a score of an accuracy of the determination when the mass of the observed peak is determined to match the mass of at least one of the plurality of expected peptides. The precursor ion is excluded from an MS/MS scan when the accuracy score indicates that the determination is accurate.

20 Claims, 4 Drawing Sheets

(56) References Cited

OTHER PUBLICATIONS

T. Yokosuka et al., 2006, "Information-based-acquisition (IBA) technique with an ion-trap/time-of-flight mass spectrometer for high throughput and reliable protein profiling", Rapid Comm. in Mass Spectrometry 20: pp. 2589-2595.

Sanders et al., Prediction of Peptides Observable by Mass Spectrometry Applied at the Experimental Set Level:, BMC Bioinformatics (2007), 8 (Suppl 7): S23, Nov. 1, 2007.

Aho et al., 1975, "Efficient String Matching: An Aid to Bibliographic Search", J. Commun. ACM 18: pp. 333-340, Jun. 1975.

Related to co-pending U.S. Appl. No. 12/465,001, filed May 13, 2009.

* cited by examiner

SYSTEM AND METHOD FOR PERFORMING TANDEM MASS SPECTROMETRY ANALYSIS

BACKGROUND

Generally, mass spectrometers measure mass-to-charge ratios of charged samples, enabling contents of the samples to be identified. Use of mass spectrometers has been expanded to include identification of proteins and corresponding peptides. This requires ions of a protein in the sample to be volatilized, in accordance with a variety of volatilizing techniques, such as electrospray ionization (ESI) and matrix-assisted laser desorption and ionization (MALDI) and provided to a mass analyzer of the mass spectrometer. The proteins and peptides may then be identified, for example, by matching the measured mass-to-charge ratios to a database of mass-to-charge rations of known proteins and peptides. Tandem mass spectrometry (MS/MS) provides multiple stage measurements of a sample, for example, using separate analyzers corresponding to the multiple stages, or using a single analyzer to analyze the sample multiple times.

Currently, powerful computer processing and enhanced performance of bioinformatics tools that analyze mass spectrometry data make it possible to match results of an MS/MS scan of a sample to a peptide in real-time. That is, the peptide may be identified in a timescale comparable to the time between two successive acquisition events of a mass spectrometer (i.e., the time it takes to acquire one spectrum).

Bottom-up acquisition protocols for MS/MS have increased sample coverage by applying different rules on how to select the most intense precursor ions of a sample for further MS/MS acquisition. For example, rules on ion intensities have been used whereby a precursor ion exclusion list may be built based on information collected on the first of two consecutive runs of a sample, known as repetitive liquid chromatography (LC)-MS/MS. While repetitive LC-MS/MS extends coverage, it also doubles acquisition time, thus becoming impractical in high throughput workflows.

BRIEF DESCRIPTION OF THE DRAWINGS

The representative embodiments are best understood from the following detailed description when read with the accompanying drawing figures. It is emphasized that the various features are not necessarily drawn to scale. In fact, the dimensions may be arbitrarily increased or decreased for clarity of discussion. Wherever applicable and practical, like reference numerals refer to like elements.

DETAILED DESCRIPTION

In the following detailed description, for purposes of explanation and not limitation, illustrative embodiments disclosing specific details are set forth in order to provide a thorough understanding of an embodiment according to the present teachings. However, it will be apparent that other embodiments according to the present teachings that depart from the specific details disclosed herein remain within the scope of the appended claims. Moreover, descriptions of well-known devices and methods may be omitted so as to not obscure the description of the example embodiments. Such methods and devices are clearly within the scope of the present teachings.

In the various embodiments, peptide sequence information is used in real-time, through matches of spectra to peptides, in a tandem mass spectrometry (MS/MS) acquisition process. More particularly, peptide sequence information can be used to increase otherwise limited sample coverage of tandem mass spectrometers (e.g., limiting protein coverage).

Generally, according to various embodiments, an initial dynamic watch list of proteins is established, for example, through prior knowledge of proteins expected to be present in the sample. The dynamic watch list includes masses of expected peptides corresponding to the proteins. As data acquisition continues, newly identified proteins and masses of their corresponding expected peptides (i.e., peptides belonging to the proteins, but not yet observed) are added to the dynamic watch list. Various embodiments use empirical knowledge of the sequence of proteins that have been confidently identified to populate the dynamic watch list. With knowledge of the sequence of proteins, exclusion criteria may be built, e.g., based on the expected peptides corresponding to the list of proteins.

Meanwhile, peptides which are confirmed to be present on the dynamic watch list, are not fully acquired, since doing so would be redundant. Results include more efficient identification of peptides on the dynamic watch list, as well as increased protein and/or peptide identifications. Also, data acquisition in proteomics workflows and/or in the analysis of complex protein samples, for example, may be improved.

Figure 1:
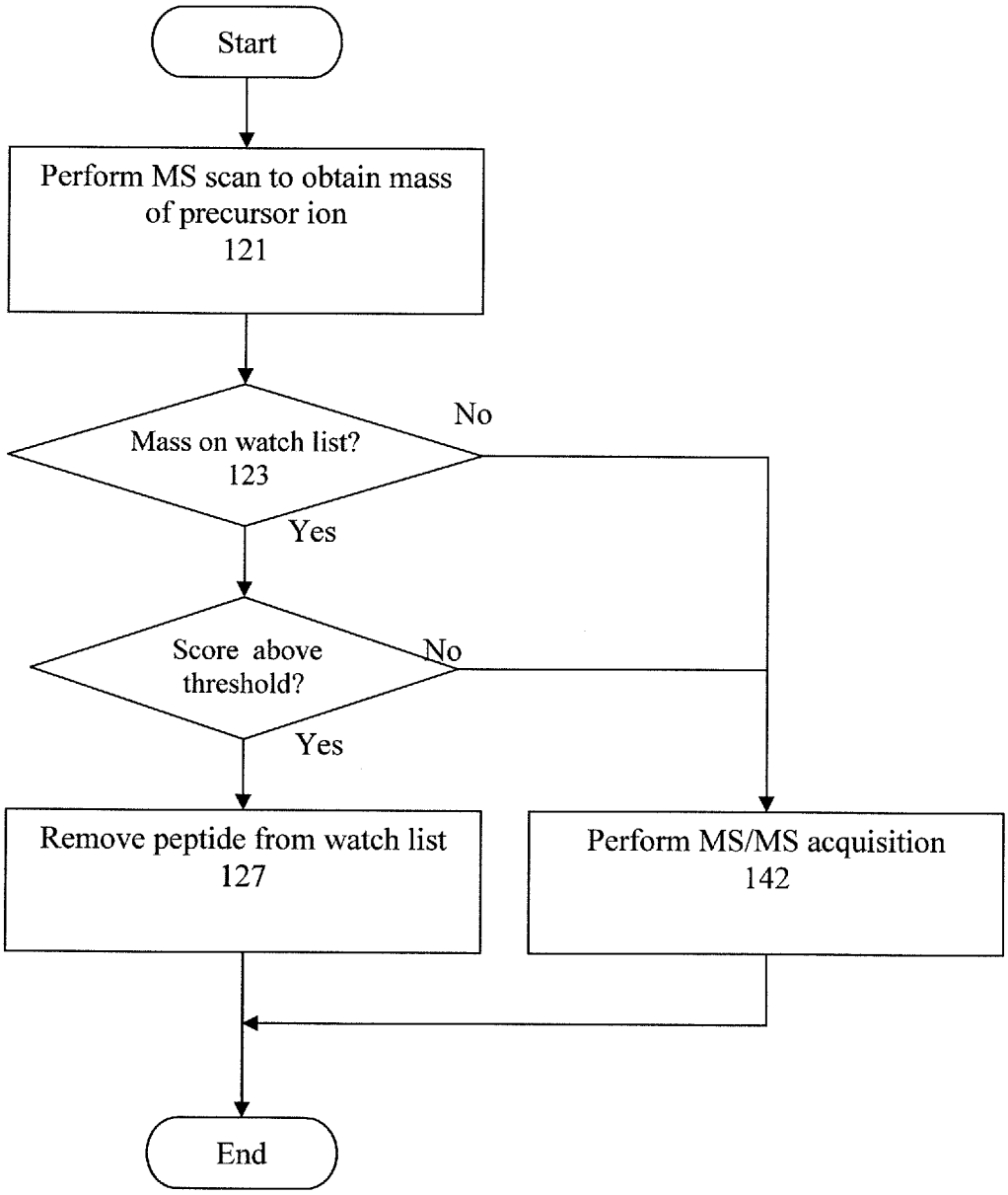
FIG. 1 is a flow diagram of a method for performing tandem mass spectrometry analysis using a watch list, according to a representative embodiment.

FIG. 1 is a flow diagram of a method for performing tandem mass spectrometry analysis using a watch list, according to a representative embodiment.

In block 121, an MS scan is performed on a sample to acquire a mass spectrum having peaks corresponding to masses of precursor ions. The precursor ion masses are compared to masses of expected peptides on a previously established dynamic watch list (e.g., the initial dynamic watch list, discussed above) at block 123. As discussed above, the expected peptides correspond to proteins in the sample.

For each precursor ion mass that does not match an expected peptide mass on the dynamic watch list (block 123: No), a full MS/MS scan is performed, including fragmentation of the respective precursor ion, to identify the corresponding peptide. For each precursor ion mass that does match an expected peptide mass on the dynamic watch list (block 123: Yes), the match is scored at block 125 to assure adequacy or confidence of the match. The scoring process at block 125 may include a fast MS/MS scan of each precursor ion matching a mass of an expected peptide, discussed below.

In an embodiment, all of the precursor ion masses are sequentially compared to the expected peptide masses on the dynamic watch list before either a full MS/MS scan (block 142) or the scoring process (block 125) is performed on any of the precursor ions. In alternative embodiments, the precursor ion masses may be compared to the expected peptide masses in parallel, and/or the full MS/MS scan (block 142) or the scoring process (block 125) may be completed for one precursor ion before the mass of a subsequent precursor ion is compared to the expected peptide masses on the dynamic watch list.

When the scoring process indicates sufficient confidence in the match between masses of a precursor ion and an expected peptide on the dynamic watch list (block 125: Pass), the expected peptide is removed from the dynamic watch list and no further MS/MS scans are performed on the corresponding precursor ion. When the scoring process indicates insufficient confidence in the match (block 125: Fail), the full MS/MS scan is performed on the respective precursor ion.

The fast MS/MS scan, performed pursuant to the scoring process of block 125, for example, quickly confirms the identity of a precursor ion, saving valuable acquisition time. The saved acquisition time may be used for scanning other ions, thus increasing sequence coverage within the time constraints imposed by the chromatography. The fast MS/MS scan differs from a regular, full MS/MS scan in that the detector of the mass spectrometer (e.g., detector 220 in FIG. 2, below) spends less time collecting transient signals. The time savings are particularly apparent while acquiring spectra of large proteins, for which several of the associated peptides ionize efficiently. In contrast, conventional methods needlessly perform full acquisition for all ions belonging to the large protein.

When deciding whether the fast MS/MS scan of a precursor ion matches a candidate peptide on the dynamic watch list, prior information about other peptides present in the sample may be used in order to establish the likelihood that the candidate peptide is present in the sample. The likelihood of the presence of the candidate peptide is then used to establish a peptide-specific threshold for scoring the quality of the match. Establishing the peptide-specific threshold, e.g., using prior information of the sample composition decreases the rate of false positive and false negative spectrum-to-peptide assignments, as compared to a situation in which the threshold for confirmation of precursor ions is constant. Thus, using prior information about the sample composition makes confirmation of the identity of the precursor ion more reliable than not assuming any prior knowledge.

Figure 2:
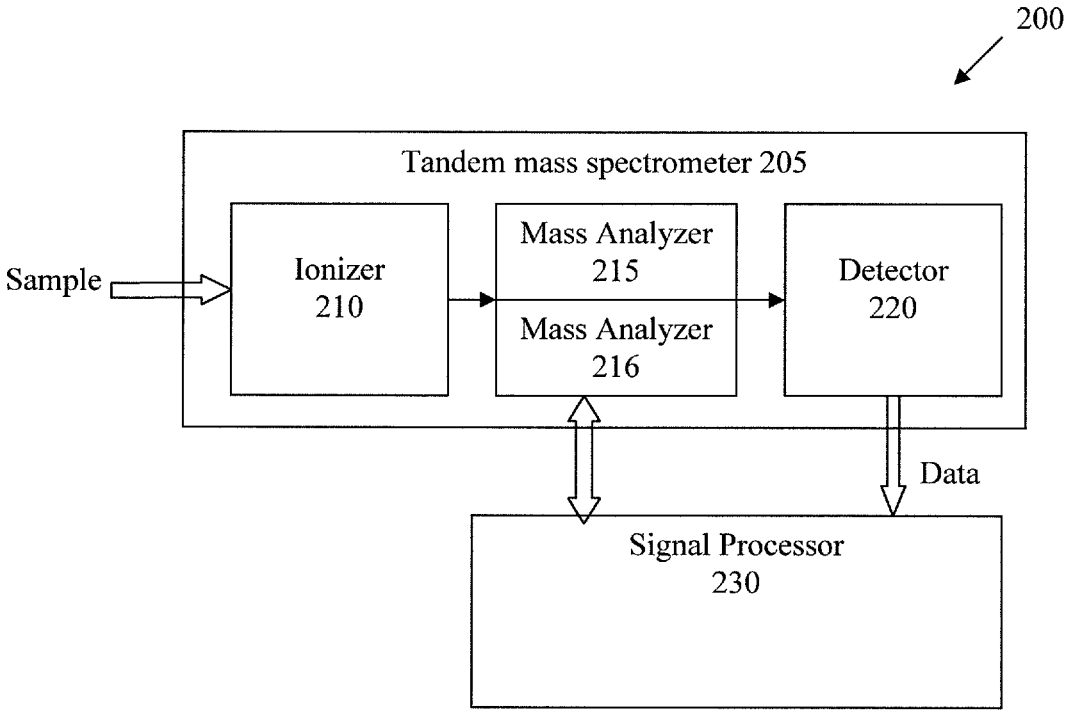
FIG. 2 is a functional block diagram illustrating a system for performing tandem mass spectrometry analysis, according to a representative embodiment.

FIG. 2 is a functional block diagram illustrating a tandem mass spectrometry system 200, according to a representative embodiment. The tandem mass spectrometry system 200 collects, measures, processes and/or analyzes various samples for identification of the molecular contents, such as peptides, amino acids, proteins and the like.

In the depicted representative embodiment, the tandem mass spectrometry system 200 includes a tandem mass spectrometer 205 and a signal processor 230. The tandem mass spectrometer 205 includes an ionizer 210, mass analyzers 215 and 216, and a detector 220. The ionizer 210 receives samples that include proteins to be identified, each protein consisting of corresponding peptides. The ionizer 210 may be an ESI or MALDI source, for example, that ionizes the sample proteins to provide precursor ions to the mass analyzers 215 and 216. During an MS/MS scan, the mass analyzer 215 selects and fragments precursor ions and the mass analyzer 216 sorts the precursor ions according to respective masses. Although two representative mass analyzers 215 and 216 are shown, the tandem mass spectrometer 200 may include additional mass analyzers. The sorted ions are provided to detector 220, which measures the abundance of ions of the various masses in a mass range mass, to generate qualitative or quantitative data regarding the sample.

The signal processor 230 performs various processing operations relating to the MS/MS acquisition, including peptide and protein identification, in accordance with various embodiments discussed below with respect to FIG. 3. As stated above, although depicted separately, the signal processor 230 may be included within one or any combination of the ionizer 210, the analyzer 215 and the detector 220, in various embodiments.

Figure 3:
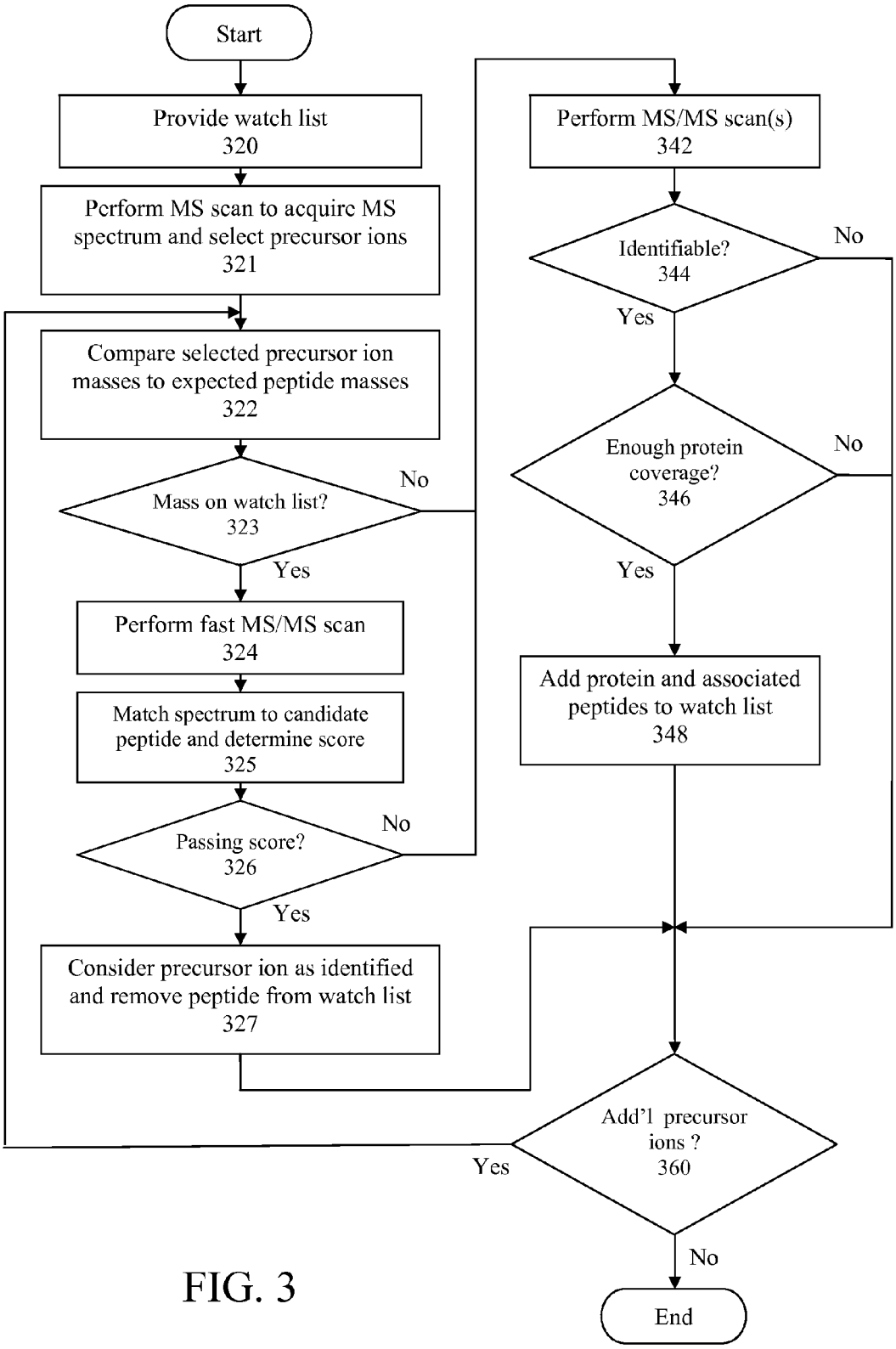
FIG. 3 is a flow diagram of a method for performing tandem mass spectrometry analysis using a watch list, according to a representative embodiment.

FIG. 3 is a flow diagram illustrating a method of performing tandem mass spectrometry analysis using a watch list, according to a representative embodiment. More particularly, FIG. 3 shows a process for comparing precursor ion masses, obtained by an initial MS scan, with expected peptide matches from a dynamic watch list, and excluding match precursor ions from further MS/MS scans. The various operations of the method may correspond to modules, realized by hard-wired logic circuits or customizable hardware, a program running on a processor, such as signal processor 230, or any combination thereof.

Block 320 of FIG. 3 indicates a process by which the initial dynamic watch list is provided. The process of block 320 is optional, since, in some embodiments, the dynamic watch list starts as an empty list. The initial dynamic watch list includes at least one protein which is known to be in the sample (each referred to as an "expected protein") and peptides corresponding to each expected protein on the list and thus expected to be present in the sample (referred to as "expected peptides"), as well as corresponding masses, sequences and other properties of the expected peptides. In an embodiment, the initial dynamic watch list is provided before beginning acquisition of mass spectra and contains a list of expected proteins and corresponding expected peptides. For example, the initial dynamic watch list may include expected proteins known to be present in the sample, e.g., due to the nature of the sample or because the sample has been "spiked" with the expected proteins. In various embodiments, the expected proteins are manually entered on the initialized dynamic watch list by a user, for example, or obtained automatically from a database of expected proteins/expected peptides.

Alternatively, as stated above, the initial dynamic watch list of block 320 may simply be an empty list, which is incrementally populated through MS and MS/MS scans and corresponding peptide identification. That is, once a peptide or set of peptides has been successfully identified, the protein(s) which contains the peptide(s) can be identified. For example, the protein(s) may be immediately identified following an indexing scheme of the type used in peptide sequence databases. In order to establish confidently the presence of the protein in the sample, a minimum number of different peptides (e.g., two or three) may be required. Alternatively a single peptide with a very high score may be acceptable for protein identification.

Once a protein is identified, a list of the corresponding expected peptides, such as tryptic peptides or other proteolytic peptides depending on sample preparation, is generated. The expected peptides, as well as corresponding masses, sequences and other properties of the expected peptides are added to the dynamic watch list corresponding to the identified protein.

Referring again to FIG. 3, an MS scan takes place at block 321 to obtain an MS spectrum, which has peaks corresponding to precursor ions of the sample. More particularly, the MS scan produces a mass spectrum composed of a measured abundance at each of a number of discrete masses in a range of masses, and the mass spectrum exhibits peaks at certain masses. The masses of the observed peaks, corresponding to precursor ions, are compared to the masses of the expected peptides on the dynamic watch list at block 322. It is determined whether the mass of each observed peak matches the mass of a respective one of the expected peptides (referred to as a "candidate peptides") in the dynamic watch list at block 323. When the mass of the observed peak matches the mass of one of the expected peptides in the dynamic watch list (block 323: Yes), precursor ions of the corresponding mass may be excluded from subsequent full MS/MS acquisitions and processing, as discussed below.

In an embodiment, the precursor ions corresponding to masses found on the dynamic watch list are excluded from subsequent full MS/MS scans and processing performed after subsequent determinations have been made in blocks 324 through 327 of FIG. 3. More particularly, a scoring process is performed in blocks 324 through 327 to prevent observed peaks from being improperly matched with expected peptides in the dynamic watch list, and such precursor ions thus being improperly excluded from subsequent MS/MS acquisitions. For example, as stated above, the dynamic watch list grows as acquisition continues. When the dynamic watch list becomes too large, peptides from proteins unrelated to the proteins in the dynamic watch list may be improperly excluded because masses of the unrelated peptides match the masses of expected peptides in the dynamic watch list merely by chance. As the dynamic watch list grows, the probability of chance matches increases. The scoring process in blocks 324 through 327 is intended to prevent such false matches.

In a representative embodiment, a fast MS/MS scan is performed at block 324 to obtain an observed product ion mass spectrum of the observed peak. In an embodiment, the tandem mass spectrometer 205 is used to select precursor ions corresponding to an observed peak corresponding in mass to one of the expected peptides in the dynamic watch list and to fragment the precursor ions. The tandem mass spectrometer 205 is then used to measure an observed product ion mass spectrum, which is the mass spectrum of the product ions corresponding to the observed peak. The observed product ion mass spectrum is compared to the spectrum of the candidate peptide in block 325 to provide a score associated with the match of the mass spectrum to the observed peak. That is, the observed product ion mass spectrum from the fast MS/MS scan is compared to the known product ion mass spectrum of the candidate peptide at block 325, resulting in a score that represents the similarity between the observed peak and the candidate peptide. Notably, the discussion above refers to a single precursor ion, a single observed peak and a single candidate peptide for the sake of clarity, although multiple precursor ions, observed peaks and/or candidate peptides may be processed simultaneously. For example, the observed product ion mass spectrum of the observed peak may be scored against the known product ion mass spectra of some or all of the expected peptides in the dynamic watch list, as discussed below.

Referring again to block 325, any appropriate scoring functions may be used, without departing from the scope of the disclosure. For example, one representative probabilistic scoring method includes a hypothesis test, which compares between two competing hypotheses regarding the relationship between an observed product ion mass spectrum and a peptide sequence. In a first hypothesis, peaks appearing in the observed product ion mass spectrum are the result of ions resulting from true cleavages taking place in the fragmentation process induced by a mass spectrometer. In the first hypothesis, some combinations of peaks (mass fragments) and peak intensities occur more frequently than others. In a second hypothesis, the peaks are the result of ions generated by a random fragmentation process. The score for the comparison of the observed product ion mass spectrum, S (obtained in block 324) and the known product ion mass spectrum of each candidate peptide, P in the dynamic watch list can be defined as follows:

$$\text{Score}(S, P) = \log\left(\frac{Prob(S \mid P)}{Prob(S \mid R)}\right)$$

Prob(S|P) is the probability of the observed product ion mass spectrum S being generated by fragmentation of peptide P and Prob(S|R) is the probability of observed product ion mass spectrum S being generated by a random fragmentation process. The higher the score of the comparison, the more likely that the observed product ion mass spectrum corresponds to the candidate peptide.

Continuing with FIG. 3, at block 326, it is determined whether the score of only one candidate peptide is high enough to pass (block 326: Yes), resulting in identification of the peak associated with the precursor ion and excluding the identified precursor ion from further MS/MS scan(s) and processing at block 327. For example, in an embodiment, when the score is above a predetermined threshold (block 326: Yes), the peak of the precursor ion is considered to correspond to an identified peptide and that peak is subject to no further analysis. Also, the mass of expected peptide matching the mass of the precursor ion is removed from the dynamic watch list at block 327.

After the mass of the precursor ion is removed from the dynamic watch list at block 327, a determination is made whether there are additional masses corresponding to peaks of the MS scan in block 321 that have not yet been compared to the masses of expected peptides on the dynamic watch list. When there are additional masses (block 360: Yes), the process returns to block 322 to compare the next mass with the masses of expected peptides on the dynamic watch list. When there are no more masses (block 360: No), the process ends. Notably, the order of the processing operations may vary. For example, in an embodiment, all of the precursor ion masses are sequentially compared to the expected peptide masses on the dynamic watch list (blocks 322 and 323) before the scoring process (blocks 324 to 327) or a full MS/MS scan (block 342, discussed below) is performed on any of the precursor ions. Also, in alternative embodiments, the precursor ion masses may be compared to the expected peptide masses (blocks 322 and 323) in parallel.

The scoring process is relatively fast compared to standard peptide identification because there is no database search and acquiring the fast MS/MS spectrum for each new precursor ion causes only a slight decrease in acquisition performance (e.g., slight increase in time). If none of the candidate peptides provides a score above the threshold, or if more than one of the candidate peptides provides a score above the threshold (for that peptide), respectively, the decision at block 326 is declared inconclusive (block 326: No) and a full MS/MS scan of the precursor ion is executed in block 342, as discussed below.

Further, the threshold value to which the score is compared in block 326 may be determined and adjusted by a variety of techniques. For example, in a representative embodiment, the threshold value may be determined using the number of peptides (from the same protein to which the candidate peptide belongs) that have been previously identified. In other words, the threshold value used at block 326 becomes peptide-dependent. For example, it may be assumed that peptides P1 and P2 are the highest and second highest scoring peptides among peptides in the watch list that have the same mass as the observed peak. It is assumed that there are no previously identified peptides of the protein(s) to which peptide P1 belongs, but there are several peptides previously identified of the protein(s) to which P2 belongs. Thus, at block 326, the threshold value for matching the fast MS/MS spectrum with peptide P2 may be set lower than that of peptide P1, since there is a high likelihood that peptide P2 is present in the sample, e.g., based on previously obtained information. However, there is no previously obtained information on whether peptide P1 exists in the sample. A peptide dependent threshold value is possible through access to peptide sequence information of previously acquired mass spectra.

In another representative embodiment, observed peak intensities of peptides previously identified (which belong to the same protein as the candidate peptide) are used in support of lowering the threshold value for the score test performed at block 326. For example, the score threshold value is lowered when intensities of the observed peaks of previously identified peptides from the same protein correlate well with the intensity of the observed peak being scored. In another representative embodiment, properties of the observed peptide being matched to the observed product ion mass spectrum are used to establish the peptide-dependent score threshold value. The peptide properties include, but are not limited to, predicted retention time of the peptide and how proteotypic the peptide is.

In the first example, retention time is the time at which a peptide with a particular sequence elutes from reverse phase chromatography. The retention time is predicted or estimated using models, such as a Sequence Specific Retention Calculator. In the Sequence Specific Retention Calculator model, properties like the retention coefficient assigned to each amino-acid, nearest neighbors effects, clusters of hydrophobic amino acids, proline content, isoelectric point of the peptide, peptide length, and propensity for helical structure, for example, are taken into account to estimate the predicted elution time of the peptide. In the second example, proteotypic peptides refer to peptides of a protein that are frequently observed in a mass spectrometry experiment. Not all peptides have the same likelihood of being detected by mass spectrometry. For instance, peptides may not be observed due to incomplete proteolytic digestion, poor binding or elution from the chromatography column, small size, and/or poor ionization. There are classification models that can determine how likely it is that a peak corresponding to a particular peptide will be observed in a mass spectrum, such as the classification model described by Sanders et al., *Prediction of Peptides Observable by Mass Spectrometry Applied at the Experimental Set Level*, BMC Bioinformatics (2007), 8 (Suppl 7): S23, the contents of which is hereby incorporated by reference. Typical features of the peptide used in the classification models include, for example, number of pralines, percentage of glycine, alanine, leucine, polar amino acids, hydrophobic amino acids and negative amino acids, size, amphiphilicity index, and propensity to form helices. It the representative embodiment, predicted retention time and proteotypic nature of a peptide can be predicted because the sequence of each previously identified peptide may be used.

Using sequence information of peptides previously identified at block 326 enables customization of score thresholds to take into account the likelihood of the observed peptide being present in the sample at that particular time in the chromatography. For example, the higher the number of expected peptides, corresponding to a given protein on the dynamic watch list, for which corresponding peaks have been previously identified, the higher the likelihood that a new observed product ion mass spectrum corresponds to another expected peptide of this protein from the dynamic watch list. The peptide dependent thresholds produce more accurate peptide assignments, decreasing the rate of false positive and false negative identifications, and thus increasing the quality of the identifications made in the remainder of the process.

In a related embodiment, information from curated protein-protein interactions databases/models or physiological/disease pathways are used to adjust peptide specific score thresholds in order to decrease false assignments and to increase scoring confidence. For example, assume that more than one peptide from protein A and more than one peptide from protein B have already been identified, and that a newly acquired observed product ion mass spectrum matches, with a certain score, a peptide from protein C. The threshold for accepting or rejecting this score at block 326 can be lowered based on whether proteins A, B and C work together along the same pathway or whether they are known to interact with each other, i.e., whether there is prior information indicating that proteins A, B and C can be expected in the same protein sample, together. A similar use of curated pathways for off-line (post-acquisition) processing of mass spectra is described, for example, by Freeman et al., *Identification of Biochemical Pathway Activity using Mass Spectrometry and Probabilistic Methods,* 56th ASMS Conference on Mass Spectrometry (June 2008), the contents of which is hereby incorporated by reference.

Referring again to block 326, when all of the comparison scores are below the threshold value (block 326: No), or when more than one candidate peptide provides a score above the threshold value, a full MS/MS scan of the precursor ion is performed to identify the observed peptide as a bona fide new peptide. Performing the full MS/MS scan and analyzing the resulting mass spectrum is accomplished through blocks 342 through 348.

More particularly, at block 342 a full MS/MS scan is performed, involving fragmentation of on the precursor ion. At block 344, it is determined whether the precursor ion can be identified, for example, through de novo peptide sequencing, database search, or other means of peptide identification, based on the MS/MS acquisition. For example, the identification may be implemented using InsPecT, described by Tanner et al, *InsPecT. Identification of Posttranslationally Modified Peptides from Tandem Mass Spectra*, Anal. Chem., Vol. 77, No. 14. (July 2005), pp. 4626-4639, the contents of which is hereby incorporated by reference. Generally, InsPecT provides a sequence tagging algorithm that uses an efficient trie technique, in order to index large sequence databases to filter and score candidate peptides against a mass spectrum of interest. Given the trend of multiprocessor architectures, computation on GPUs, FGPAs and computer clusters, peptide identification time may be further reduced, since the algorithm used in InsPecT has been successfully parallelized.

When the precursor ion can be identified from the observed product ion mass spectrum of the full MS/MS scan (block 344: Yes), the process proceeds to block 346, which determines whether there is enough protein coverage for each of the proteins to which the identified peptide belongs. In other words, a determination is made, e.g., through the peptide mass comparison scores previously discussed and/or through any previously obtained information regarding proteins and/or peptides in the sample (including all proteins in the sample identified so far), on the probability that a protein associated with the identified peptide is present in the sample and whether that probability is high enough to proceed to block 348. For example, as discussed above, a protein is not determined to be in the sample at block 346 unless a minimum number of corresponding peptides (including the peptides identified at blocks 327 and 344) have been identified.

When there is sufficient protein coverage (block 346: Yes), the protein is added to the dynamic watch list at block 348, together with its associated expected peptides and corresponding masses, which include all peptides from the protein except the peptides previously identified at block 344 or 326. The expected peptides and corresponding masses and sequences may be obtained, for example, from a previously populated/characterized database. The masses, sequences, and any other property of the expected peptides that is considered useful (e.g. predicted retention time and proteotypic index), now part of the dynamic watch list, are then included in comparisons of subsequently acquired scans of new precursor ions, for example, at block 324. After the protein and peptides have been added to the dynamic watch list (block 348), or when there is insufficient protein coverage to decide to add the protein (block 346: No), or when the precursor ion cannot be identified (block 244: No), the process advances to block 260, where it is determined whether the acquisition process is to continue.

As discussed above, a determination is made at block 360 whether there are additional masses corresponding to peaks of the MS scan of block 321 that have not yet been compared to the masses of expected peptides on the dynamic watch list. When there are additional masses (block 360: Yes), the process returns to block 322 to compare the next mass with the masses of expected peptides on the dynamic watch list. When there are no more masses (block 360: No), the process ends. Notably, the order of the processing operations may vary. For example, in an embodiment, all of the precursor ion masses are sequentially compared to the expected peptide masses on the dynamic watch list (blocks 322 and 323) before the scoring process (blocks 324 to 327) or the full MS/MS scan (block 342) is performed on any of the precursor ions. Also, in alternative embodiments, the precursor ion masses may be compared to the expected peptide masses (blocks 322 and 323) in parallel.

Using this aggressive exclusion strategy that predicts expected peptides based on previously identified peptides, more acquisition time can be spent searching for new peptides and proteins, thus increasing the peptide and protein sequence coverage (number of different peptides/proteins) of the sample. Notably, the new proteins include post-translationally modified versions of proteins in the dynamic watch list, so the strategy also increases the coverage of post-translational modifications (PTMs).

In an alternative embodiment, when it is determined that the precursor ion can not be identified (block 344: No), subsequent MS/MS acquisition(s) of the precursor ion may be performed in an attempt to identify the new peptide. That is, the process may effectively enter a loop (not shown) between additional MS/MS acquisitions and determining whether the precursor ion can be identified based on additional information obtained in each additional MS/MS acquisition, until the precursor ion can be identified or the process times out.

The decision process at block 346 may be based on a determination of how many peptides are necessary to confidently include a new protein in the dynamic watch list, for example, at block 348. Such a determination may be affected by the biological question being asked. By using available databases that classify protein localization, function or physiological/disease pathway, a user may indicate that a particular class of proteins of interest should not be included in the dynamic watch list until a large number of corresponding peptides has been identified. Alternatively, the user could indicate that a class of proteins be aggressively excluded from full MS/MS scans, and thus placed on the dynamic watch list when as few as one peptide of the protein has been identified. For example, if Endoplasmic Reticulum (ER) contamination of a Golgi isolation is believed to have occurred during sample preparation, ER proteins could be aggressively excluded to increase coverage of the Golgi fraction, or everything else that is not associated with the ER.

The various embodiments described herein may be used for proteomics applications, although improving confidence in scores, in particular, may also be applied to metabolomics workflows. For example, the process for improving confidence in scores at blocks 324 through 327 may be applied to known metabolite distribution patterns (or fingerprints) of certain physiological states instead of pathways. Also, the watch list preciously mentioned would involve metabolites instead of proteins.

The various embodiments are intended to increase peptide and protein coverage. The dynamic watch list process generally enables protein quantitation via intensities of the peaks corresponding to precursor ions, for example. Notably, though, if spectral counting is to be implemented for quantitation, e.g., to quantify an amount of each protein or peptide, modifications may be made to take into account the fact that MS/MS spectra of some peptides will be obtained in a shorter amount of time due to block 324, in which expected peptides are identified using the fast MS/MS scan.

Regardless of the origin and contents of the dynamic watch list, the dynamic watch list grows throughout the acquisition process of a sample as more proteins are identified. Further, because use of the dynamic watch list is generally more beneficial the larger the size of the list, the benefits of the dynamic watch list are higher at later stages of the acquisition, creating an increased performance gradient over time.

However, in an embodiment, this performance gradient may be neutralized to a degree through a repetitive LC/MS strategy that uses the watch list previously mentioned. The first run is used to build a complete list of expected peptides and proteins for the dynamic watch list, this time the dynamic watch list contains all peptides from proteins observed, plus all expected, but unidentified, peptides. Unlike standard exclusion lists, which contain masses of the ions to include, the watch list of the embodiment also contains sequence information of the peptides, as well as sequence-related properties of these peptides, such as predicted (and/or actual) retention times and proteotypicity. Furthermore, the watch list contains peptides from proteins that have been confidently identified in the previous run, regardless of whether the peptides were seen in the previous run. Then, in the second run, the dynamic watch list built from the first run may be used as a starting point to which additional entries are added. This solution is comprehensive and aggressive, since it excludes not just previously observed masses from further MS/MS acquisitions, but also predicted masses (via predicted peptides of observed proteins), regardless of their ion intensities (abundance in the sample).

The various embodiments are independent of the manner in which MS/MS spectra are acquired. Most MS/MS acquisition methods select precursor ions to scan according to predetermined criteria and then, for each precursor ion selected, acquire a full MS/MS spectrum. Any MS/MS acquisition modification which improves the probability of being able to match an MS/MS spectrum to a peptide (e.g., at blocks 342 through 344) has a synergistic (additive) effect with the embodiments described above. An example of an MS/MS acquisition modification for improving the probability of matches is described in U.S. patent application Ser. No. 12/465,001 by Satulovsky, entitled Data Dependent Acquisition System and Method, filed as patent application Ser. No. 12/465,001 on May 13, 2009, and published as U.S. patent application publication No. 2010/0288917 on Nov. 18, 2010, the contents of which is hereby incorporated by reference.

Figure 4:
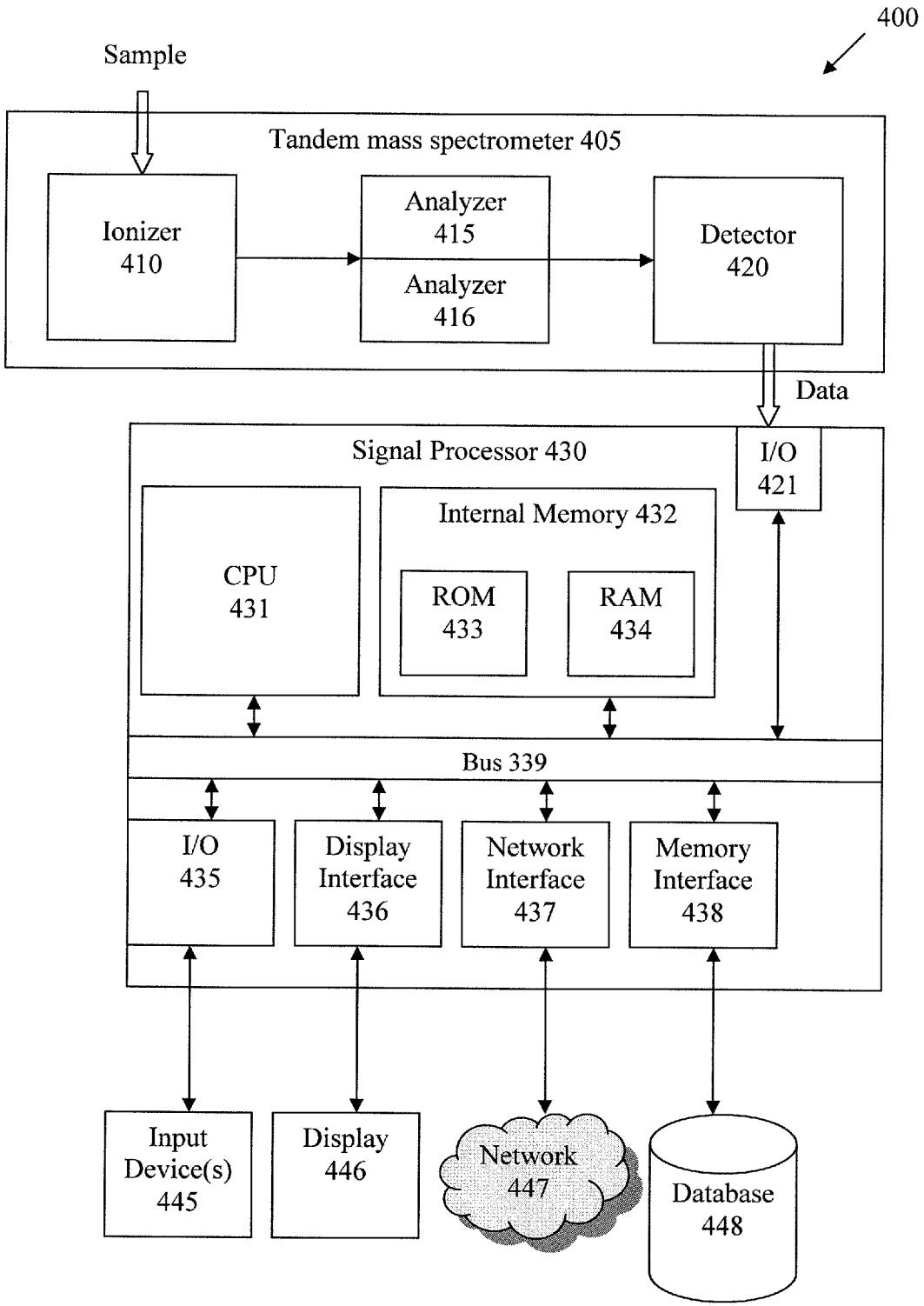
FIG. 4 is a functional block diagram illustrating a system for performing tandem mass spectrometry analysis, according to a representative embodiment.

FIG. 4 is a functional block diagram illustrating a tandem mass spectrometry system 400, according to a representative embodiment. The tandem mass spectrometry system 400 may be part of an LC/MS/MS system, for example, which collects, measures, processes and/or analyzes various samples for identification of the molecular contents, such as peptides, amino acids, proteins and the like.

In the depicted representative embodiment, the tandem mass spectrometry system 400 includes a tandem mass spectrometer 405 and a signal processor 430. The tandem mass spectrometer includes an ionizer 410, mass analyzers 415 and 416, and a detector 420. The ionizer 410 receives samples that include proteins to be identified, each protein consisting of corresponding peptides. The ionizer 410 may be an ESI or MALDI source, for example, that ionizes the sample proteins to provide precursor ions to the mass analyzers 415 and 416.

During an MS/MS scan, the mass analyzer 415 selects and fragments precursor ions and the mass analyzer 416 sores the precursor ions according to respective masses. Although two representative mass analyzers 415 and 416 are shown, the tandem mass spectrometer 400 may include additional mass analyzers. The multiple mass analyzers 415 and 416 may be the same type, such as quadrupole/quadrupole mass spectrum analyzers, or different types, such as quadrupole/time-of-flight (Q-TOF) mass spectrum analyzers, for example. The sorted ions are provided to detector 420, which measures the abundance of ions of the various masses in a mass range, to generate qualitative or quantitative data regarding the sample, as would be apparent.

The signal processor 430 performs various processing operations relating to the MS/MS acquisition, including peptide and protein identification, in accordance with various embodiments discussed above. The signal processor 430 includes central processing unit (CPU) 431, internal memory 432, bus 439 and interfaces 435-438, and is configured to receive data from the detector 420 through detector interface 421. In various embodiments, the signal processor 430 also interfaces with the ionizer 410 and the mass analyzers 415 and 416, as needed, through respective interfaces (not shown). As stated above, it is understood that, although depicted separately, the signal processor 430 may be included within the detector 420, or any combination of the ionizer 410, the mass analyzers 415 and 416, and the detector 420, in various embodiments.

With respect to the signal processor 430, the internal memory 432 includes at least nonvolatile read only memory (ROM) 433 and volatile random access memory (RAM) 434, although it is understood that internal memory 432 may be implemented as any number, type and combination of ROM and RAM, and may provide look-up tables and/or other relational functionality. In various embodiments, the internal memory 432 may include a disk drive or flash memory, for example. Further, the internal memory 432 may store program instructions and results of calculations or summaries performed by CPU 431.

The CPU 431 is configured to execute one or more software algorithms, including the peptide detection process using a dynamic watch list of the embodiments described herein, in conjunction with the internal memory 432. In various embodiments, the CPU 431 may also execute software algorithms to control the basic functionality of the system 300. The CPU 431 may include its own memory (e.g., nonvolatile memory) for storing executable software code that allows it to perform the various functions. Alternatively, the executable code may be stored in designated memory locations within internal memory 432. The CPU 431 executes an operating system, such as Windows® operating systems available from Microsoft Corporation, Linux operating systems, Unix operating systems (e.g., Solaris™ available from Sun Microsystems, Inc.), or NetWare® operating systems available from Novell, Inc. The operating system may control execution of other programs, including collection and separation of samples, mass analysis and detection, e.g., by the ionizer 410, the mass analyzer 415 and the detector 420.

In an embodiment, a user and/or other computers may interact with the signal processor 430 using input device(s) 445 through I/O interface 435. The input device(s) 445 may include any type of input device, for example, a keyboard, a track ball, a mouse, a touch pad or touch-sensitive display, and the like. Also, information may be displayed by the signal processor 430 on display 446 through display interface 436, which may include any type of graphical user interface (GUI), for example. The displayed information includes the processing results obtained by the CPU 431 executing the method of peptide, described herein.

The processing results of the CPU 431 may also be stored in the database 348 through memory interface 438. The database 448 may include any type and combination of volatile and/or nonvolatile storage medium and corresponding interface, including hard disk, compact disc (e.g., CD-R/CD/RW), universal serial bus (USB), flash memory, or the like. The stored processing results may be viewed, e.g., on the display 446, and/or further processed at a later time. Also, the processing results may be provided to other computer systems connected to network 447 through network interface 437. The network 447 may be any network capable of transporting electronic data, such as the Internet, a local area network (LAN), a wireless LAN, and the like. The network interface 437 may include, for example, a transceiver (not shown), including a receiver and a transmitter, that provides functionality for the tandem mass spectrometry system 400 to communicate wirelessly over the data network through an antenna system (not shown), according to appropriate standard protocols. However, it is understood that the network interface 437 may include any type of interface (wired or wireless) with the communications network, including various types of digital modems, for example.

The various "parts" shown in the signal processor 430 may be physically implemented using a software-controlled microprocessor, hard-wired logic circuits, or a combination thereof. Also, while the parts are functionally segregated in the signal processor 430 for explanation purposes, they may be combined variously in any physical implementation.

In accordance with various embodiments, protein and post-translational modifications coverage of a proteomics sample is increased, effectively extending the protein coverage of the tandem mass spectrometer. Increased coverage is achieved by predicting, based on information from previously acquired spectra, precursor ion masses that should only be confirmed and not analyzed during future acquisition events.

While specific embodiments are disclosed herein, many variations are possible, which remain within the concept and scope of the invention. Such variations would become apparent after inspection of the specification, drawings and claims herein. The invention therefore is not to be restricted except within the scope of the appended claims.

What is claimed is:

1. A system for performing tandem mass spectrometry (MS/MS) analysis of a sample, the system comprising:

a mass spectrometer configured to perform a mass spectrometry (MS) scan of an ionized sample to provide a mass of an observed peak corresponding to a precursor ion; and a processor configured to perform operations comprising:

determining whether the mass of the observed peak matches a mass of at least one of a plurality of expected peptides on a dynamic watch list, the expected peptides corresponding to a protein in the sample; and calculating a score of an accuracy of the determination when the mass of the observed peak is determined to match the mass of at least one of the plurality of expected peptides, wherein the peptide is excluded from the dynamic watch list and is excluded from a full tandem mass spectrometry (MS/MS) scan by the mass spectrometer when the accuracy score indicates that the determination is accurate.

2. The system of claim 1, wherein the mass spectrometer further performs a fast MS/MS scan of the precursor ion to obtain a mass spectrum, and wherein calculating the accuracy score is based on the mass spectrum obtained from the fast MS/MS scan and a sequence of the at least one of the plurality of expected peptides.

3. The system of claim 2, wherein calculating the accuracy score further comprises:

comparing the mass spectrum obtained from the fast MS/MS scan to a plurality of score thresholds corresponding to the plurality of expected peptides on the watch list to obtain a corresponding plurality of comparison scores.

4. The system of claim 3, wherein the processor is further configured to perform operations comprising:

indicating that the determination is accurate when only one comparison score of the plurality of comparison scores exceeds a corresponding score threshold.

5. The system of claim 4, wherein the processor is further configured to perform operations comprising:

indicating that the determination is not accurate when more than one comparison score of the plurality of comparison scores exceeds corresponding score thresholds.

6. The system of claim 4, wherein the processor is further configured to perform operations comprising:

indicating that the determination is not accurate when none of the plurality of comparison scores exceeds corresponding score thresholds.

7. The system of claim 3, wherein calculating the accuracy of the score further comprises:

determining values of the plurality of score thresholds specific to the plurality of expected peptides on the watch list, respectively.

8. The system of claim 7, wherein determining a value of the score threshold corresponding to the at least one of the plurality of expected peptides comprises determining a plurality of proteins to which the at least one of the plurality of expected peptides belongs, each of the plurality of proteins comprising a corresponding plurality of peptides, and determining a number of the plurality of peptides from each of the identified plurality of proteins that has been previously identified in the sample, and wherein the value of the score threshold decreases as the number of the previously identified peptides increases.

9. The system of claim 7, wherein determining a value of the score threshold corresponding to the at least one of the plurality of expected peptides comprises determining an expected retention time of the at least one of the plurality of expected peptides based on corresponding sequence information, and wherein the value of the score threshold decreases the closer the actual retention time is to the expected retention time.

10. The system of claim 7, wherein determining a value of the score threshold corresponding to the at least one of the plurality of expected peptides comprises determining a proteotypic index of the at least one of the plurality of expected peptides based on sequence information of the at least one of the plurality of expected peptides, and wherein the value of the score threshold decreases as the proteotypic index increases.

11. The system of claim 7, wherein determining a value of the score threshold corresponding to the at least one of the plurality of expected peptides comprises determining a likelihood that the at least one of the plurality of expected peptides is in a protein with one of a plurality of other proteins previously identified in the sample, and wherein the value of the score threshold decreases as the likelihood that the at least one of the plurality of expected peptides is in the protein with the one of the plurality of other proteins.

12. The system of claim 1, wherein, when the mass of the observed peak does not match the mass of at least one of the plurality of expected peptides on the watch list, the mass spectrometer performs the full MS/MS scan of the precursor ion.

13. The system of claim 1, wherein, when the accuracy score indicates that the determination is not accurate, the mass spectrometer performs the full MS/MS scan of the precursor ion.

14. A method of performing tandem mass spectrometry (MS/MS) analysis of a sample, the method comprising:

performing a mass spectrometry (MS) scan of a precursor ion of the sample to acquire a mass of an observed peak corresponding to the precursor ion;

comparing the acquired mass to a plurality of masses corresponding to a plurality of expected peptides on a watch list, the plurality of expected peptides corresponding to at least one protein in the sample;

determining whether the acquired mass matches a mass of one of the plurality of expected peptides;

when the acquired mass is determined to match the mass of one of the plurality of expected peptides, scoring an accuracy of the match; and when the scoring indicates that the match is accurate, excluding the precursor ion from a full tandem mass spectrometry (MS/MS) scan.

15. The method of claim 14, wherein scoring the accuracy of the match comprises:

performing a fast MS/MS scan of the precursor ion to obtain a spectrum of the mass of the observed peptide; and scoring the mass against masses and sequences of the plurality of expected peptides on the watch list to obtain a corresponding plurality of scores.

16. The method of claim 15, further comprising:

determining that the scoring indicates that the match is accurate when only one score of the plurality of scores exceeds a corresponding threshold value.

17. The method of claim 16, further comprising:

determining that the scoring indicates that the match is not accurate when more than one score of the plurality of scores exceeds corresponding threshold values.

18. The method of claim 17, further comprising:

when the scoring indicates that the match is not accurate, performing at least one full MS/MS scan of the precursor ion to identify a peptide corresponding to the precursor ion;

determining whether the identified peptide is sufficient to identify a new protein; and adding the new protein to the watch list when the identified peptide is sufficient to identify the new protein.

19. The method of claim 18, wherein determining whether the identified peptide is sufficient to identify the new protein comprises:

determining whether the identified peptide, when combined with at least one previously acquired peptide from the sample, provides a threshold number of peptides corresponding to the new protein sufficient to identify the new protein.

20. A computer readable medium that stores a program, executable by a computer, for performing tandem mass spectrometry (MS/MS) analysis of a sample, the computer processor operating in response to the program to perform operations comprising:

comparing a mass of an observed peak of a precursor ion, obtained by a mass spectrometry (MS) scan, to a plurality of masses corresponding to a plurality of expected peptides on a watch list, the plurality of expected peptides corresponding to at least one protein in the sample;

determining whether the mass matches a mass of one of the plurality of expected peptides;

scoring an accuracy of the match when the mass is determined to match the mass of one of the plurality of expected peptides, and excluding the precursor ion from a subsequent full MS/MS scan when the scoring indicates that the match is accurate.

* * * * *